350-345 SR
PWE09 XR 4,247,928

United States Patent [19]

Dorfman

[11] 4,247,928

[45] Jan. 27, 1981

[54] INTEGRAL LIGHTPIPE AND DISPLAY HOLDER FOR A TIMEPIECE

[75] Inventor: Leonard M. Dorfman, Santa Clara, Calif.

[73] Assignee: Timex Corporation, Middlebury, Conn.

[21] Appl. No.: 86,009

[22] Filed: Oct. 17, 1979

[51] Int. Cl.[3] ..... G04B 19/30
[52] U.S. Cl. ..... 368/67; 368/227
[58] Field of Search ..... 58/50 R, 23 R, 23 BA; 362/30, 31; 350/345; 340/765, 784, 380; 368/67, 227

[56] References Cited

U.S. PATENT DOCUMENTS

| | | | |
|---|---|---|---|
| 2,831,282 | 4/1958 | Hardesty | 362/31 X |
| 3,983,689 | 10/1976 | Burke et al. | 58/50 R |
| 3,994,564 | 11/1976 | Somogyi | 350/345 |
| 4,043,636 | 8/1977 | Eberhardt et al. | 350/345 |
| 4,096,550 | 6/1978 | Baier et al. | 350/345 X |
| 4,126,383 | 11/1978 | Doriguzzi et al. | 350/345 X |

*Primary Examiner*—Ulysses Weldon
*Attorney, Agent, or Firm*—William C. Crutcher

[57] ABSTRACT

A pod which holds the components of an electronic timepiece including the electro-optic display, substrate board and light source for illuminating the display is molded of transparent light transmitting material to pipe the light throughout the portion of the pod behind the display for backlighting the display.

8 Claims, 4 Drawing Figures

INTEGRAL LIGHTPIPE AND DISPLAY HOLDER FOR A TIMEPIECE

Background of the Invention

This invention relates generally to electronic timepieces of the type having a backlighted display, and more particularly it pertains to improvements in the pod holding the timepiece components and an improved arrangement for backlighting the display.

Electro-optic displays for timepieces, such as liquid crystal displays have been used extensively in digital watches. Such watches are generally assembled from components including an electro-optic display of the liquid crystal type, a substrate board carrying an integrated circuit, connectors interposed between the substrate board leads and the display, a quartz crystal time base, batteries, a pod of insulating material with suitable recesses for holding the various components, and means to clamp the assembly together in a "module." The module comprises the "movement" of the timepiece which is placed in a suitable case. An example of the foregoing type of assembly is seen in U.S. Pat. No 3,863,436 issued Feb. 4, 1975 to Schwarzchild et. al. and assigned to the present assignee.

Electro-optic displays, such as liquid crystal displays which can operate either in a transmissive or reflective mode, often employ a backlight for viewing at night. Exemplary of such patents are U.S. Pat. No 3,864,905 issued Feb. 11, 1975 to Richardson; British Pat. No. 1,417,958; U.S. Pat. No. 4,043,636 issued Aug. 23, 1977 to Noel Eberhardt; and pending applications Ser. No. 935,187 filed Aug. 21, 1978 in the name of P. Hochstrate (non U.S. Pat. No. 4,196,973 and Ser. No. 19,698 filed Mar. 12, 1979 in the name of N. Eberhardt. The latter pending applications are assigned to the present assignee.

Very often, illuminating devices for timepieces include a "lightpipe" of transparent material such as glass or transparent plastic to guide the light to the point where it is diffused. Illustrative of such devices are U.S. Pat. 3,043,038 issued July 10, 1962 to Marble; U.S. Pat. No. 3,043,947 issued July 10, 1962 Albinger and U.S. Pat. No. 3,574,993 issued Apr. 13, 1971 to Black.

The lightpipes and backlighting devices in the prior art have generally been constructed and arranged for the specific purpose of guiding, scattering, diffusing or otherwise controlling the light. On the other hand, the structural components for holding the timepiece components, such as the aforementioned Schwarzchild et. al. patent, are constructed with a view toward their functional capabilites as support members. This results in a large number of parts for the display backlight, and has also lead to more bulky constructions for the backlight components which is undesirable in a timepiece especially in a wrist watch.

Accordingly, one object of the present invention is provide an improved lightpipe for an electro-optic display backlighting arrangment.

Another object of the invention is provide an improved timepiece with a reduced number of components for the backlighting assembly.

Still another object of the invention is provide an improved timepiece having an intergral lightpipe and display holder.

Drawing

The invention, both as to organization and method of practice, together with further objects and advantages thereof, will best be understood by reference to the following descriptions taken in connection with the accompanying drawings, in which:

FIG. 1 is a cross-sectional elevation drawing of an electronic timepiece module, FIG. 2 is a simplified exploded perspective drawing of the major timepiece components in the module, and FIGS. 3 and 4 are plan view and side elevation drawings of the improved transparent pod and lightpipe which is the object of the present invention.

Summary of the Invention

Briefly stated, the invention comprises the improvement in a timepiece having components including an electro-optic display, a substrate board carrying an integrated circuit, and a light source for illuminating the display; characterized by an improved pod molded of transparent light-transmitting material, the pod having peripheral portions adapted to receive the display and substrate board and having a central integral flat portion interposed between the display and substrate board. The light source is preferably disposed in a recess adjacent the flat portion, which acts as a lightpipe for illuminating the back of the display.

Description of the Preferred Embodiment

Figure 1:
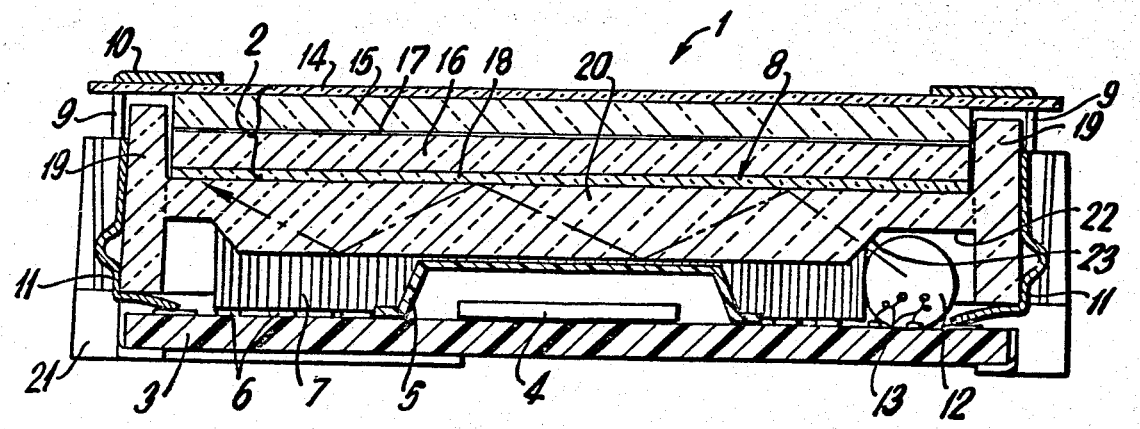

Referring to FIG. 1 of the drawing, a cross-section drawing is shown of a module for a timepiece utilizing the present invention. The module assembly is shown for a digital wrist watch and is inserted into a wrist watch case (not shown). The module, shown generally at 1, includes a number of major components such as an electro-optic display 2, a substrate board 3 having an integrated circuit 4. The integrated circuit 4 is protected and enclosed within a cover 5. Substrate 3 has printed circuit leads on its upper surface which interconnect the integrated circuit terminals with external terminals 6. These are electrically connected to similar terminals on electro-optic display 2 by means of elastomeric conductors 7. The assembly is held in a supporting member comprising a molded plastic pod 8 by means of metal tabs 9 extending from an upper metal frame 10 surrounding the electro-optic display viewing area. Additional metal tabs 11 are held by pod 8 and make contact with terminals on the substrate board 3. Tabs 11 act as switches terminals when they are contacted by buttons (not shown) held in the watchcase.

Another major component disposed on substrate board 3 is a miniature incandescent lamp 12 which is preferably supported by the electric leads 13 so that it will move slightly and adjust its position when the assembly is performed.

Electro-optic display 2 may be one of several types of liquid crystal displays which can operate in a transmissive mode so that the indicia indicating the time can be seen at night when illuminated from the backside of the display. The preferable electro-optic display for the present invention is a field effect twisted nematic type having a top polarizing sheet 14, transparent substrates 15, 16 having a liquid crystal material 17 sealed therebetween, and a bottom polarizer diffuser member 18. The latter may be a sandwich construction of a polarizing sheet and a sheet of thin translucent material such a polypropylene to scatter and diffuse the light received from beneath the display. A suitable polarizer and diffuser is disclosed in the aforementioned U.S. Pat. No. 4,196,973 assigned to applicant's assignee, and issued Apr. 8, 1980 in the name of P. Hochstrate.

Figure 2:
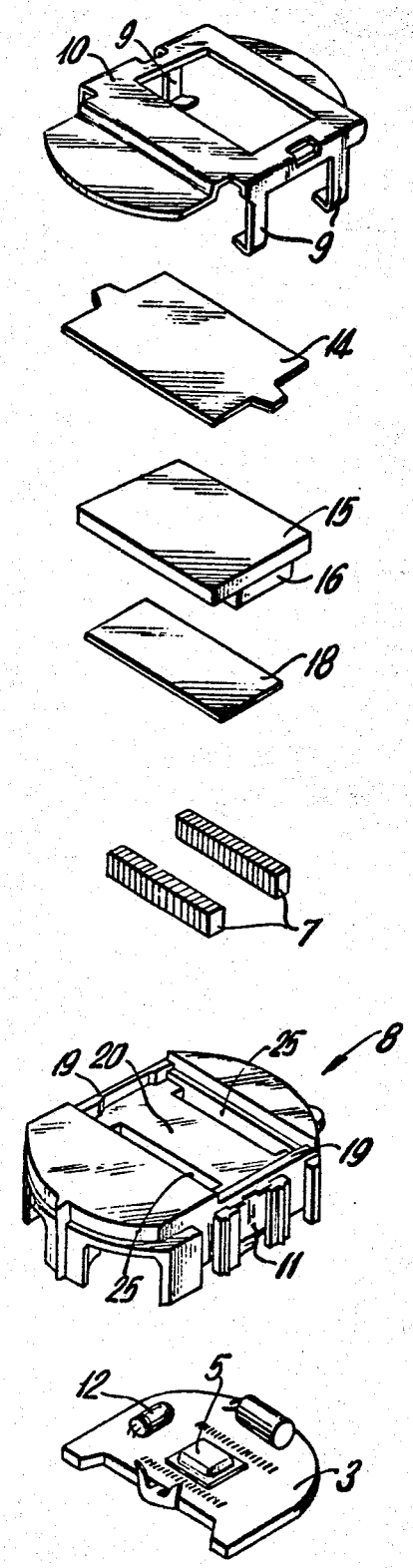

Reference to the exploded perspective view of FIG. 2 illustrates the aforementioned components and how they are assembled in a sandwich construction, located by peripheral portions of the pod 8 and held together by the metal clips 9 attached to the top frame 10.

In accordance with the present invention, referring to FIG. 1 of the drawing, the pod 8 is molded of transparent light-transmitting material. A preferred material is clear polycarbonate plastic, although acrylic plastic is also suitable for some applications. The pod includes peripheral portions 19 serving to receive and locate the electro-optic display 2 above a central integral flat portion 20. Pod 8 also includes other peripheral portions shown at 21 receiving and locating the substrate board 3 on the opposite side of the central flat portion 20 from display 2. The central flat portion of the pod is adapted to act a "lightpipe" transmitting light from the incandescent lamp 12 throughout the space beneath the display 2. In order to accomplish this, the central portion 20 defines a lamp recess 22 to accommodate lamp 12, the recess including an inclined surface 23 forming an edge of flat portion 20 and disposed at the proper angle so that rays from lamp 12 will enter the flat portion 20 and subsequently be reflected off the upper and lower surfaces of the central portion.

Figure 3:
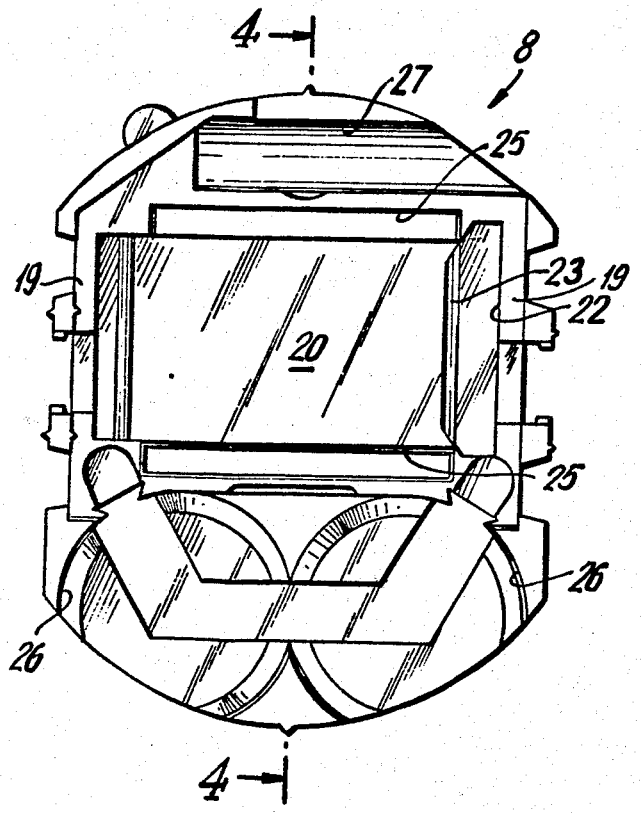
Figure 4:
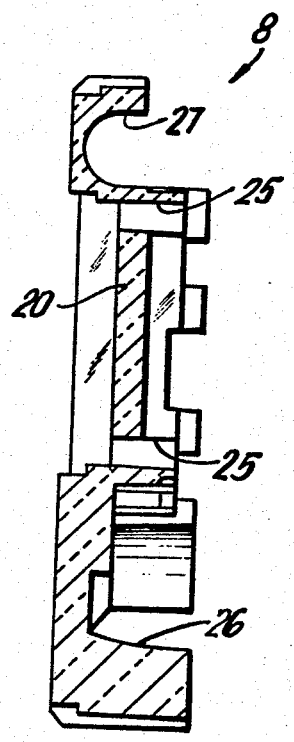

FIGS. 3 and 4 together show further details of the improved pod. The central flat portion 20 has rectangular openings 25 on either side thereof. These allow the elastomeric connectors 7 to interconnect terminals on the substrate board with terminals on the display so that the integrated circuit can actuate the electro-optic display. The pod also includes a pair of circular recesses 26 for receiving the watch batteries, and a recess 27 for receiving the quartz crystal timebase. The aforementioned recess 22 for receiving the lamp 12 adjacent the central flat portion is also shown.

Operation:

The operation of the invention should be apparent from the foregoing description. When assembling the components, the lamp 12 is nested in recess 22 as the substrate board 3 is located by the peripheral portions of the pod. The display components are also located by the pod and the assembly held together by the metal clips 9. When the lamp is accuated by switches (not shown) the light is transmitted through the flat central portion of the pod which acts as a lightpipe for illuminating the back of the display so that the numbers can be viewed from the front side in the dark. In the prior art, similar lightpipes were employed but these were separate members. In the prior art, pod assembly constructions were employed, but the pods were most generally of opaque plastic selected for other reasons than its light transmitting capability. In the applicant's construction, the lightpipe and structural function of the pod is combined. Thus the invention reduces the number of components in a timepiece and permits greater economy of construction, as well as reducing the size of the assembly.

While there has been described what is considered to be the preferred embodiment of the invention, other modifications will occur to those skilled in the art and it is desired to secure in the appended claims all such modifications as fall within the true spirit and scope of the invention.

I claim:

1. In a timepiece having components including an electro-optic display, a substrate board having an integrated circuit adapted to actuate the display, and a light source for illuminating the display, the improvement comprising:

a pod molded of transparent light-transmitting material, said pod having recess-forming peripheral portions adapted to receive the display and substrate board and having a central integral flat portion interposed between the display and substrate board, said light source being disposed adjacent an edge defined by said flat portion in a lamp recess defined in the pod on the substrate side thereof, whereby said pod central flat portion transmits the light from said light source throughout said portion for illuminating the back of the display.

2. The improvement according to claim 1, wherein said pod defines said lamp recess between said flat portion and one of said peripheral portions adapted to receive the light source, said recess including an inclined surface forming said edge of said flat portion.

3. The improvement according to claim 1, wherein said pod material is clear polycarbonate plastic.

4. The improvement according to claim 1, wherein said pod material is clear acrylic plastic.

5. The improvement according to claim 1, wherein said light source is a miniature incandescent lamp supported by electrical leads attached to said substrate board.

6. The improvement according to claim 1, wherein said peripheral portions define a display recess on one side of said flat portion adapted to receive the display and a substrate recess on the other side of said flat portion adapted to receive the substrate, and wherein the pod defines a lamp recess between the flat portion and one of said peripheral portions adapted to receive the light source.

7. The improvement according to claim 6 wherein said pod material is clear polycarbonate plastic.

8. The improvement according to claim 6 further including a metal clip holding the display, substrate and lamp in said recesses in the pod.

* * * * *